US011201427B2

(12) United States Patent
Gingrich, III et al.

(10) Patent No.: US 11,201,427 B2
(45) Date of Patent: Dec. 14, 2021

(54) SOCKET CONTACT FOR AN ELECTRICAL CONNECTOR

(71) Applicant: TE Connectivity Services GmbH, Schaffhausen (CH)

(72) Inventors: Charles Raymond Gingrich, III, Mechanicsburg, PA (US); Kenneth Paul Dowhower, Harrisburg, PA (US); Kyle Gary Annis, Hummelstown, PA (US); Brian Todd Klinger, Harrisburg, PA (US); Albert Tsang, Harrisburg, PA (US); Kevin Michael Thackston, York, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/774,602

(22) Filed: Jan. 28, 2020

(65) Prior Publication Data

US 2021/0234297 A1 Jul. 29, 2021

(51) Int. Cl.

| | |
|---|---|
| ***H01R 13/11*** | (2006.01) |
| ***H01R 12/52*** | (2011.01) |
| ***H01R 12/55*** | (2011.01) |
| ***H01R 12/70*** | (2011.01) |
| ***H01R 13/42*** | (2006.01) |
| ***H01R 13/502*** | (2006.01) |

(Continued)

(52) U.S. Cl.

CPC ..... *H01R 13/11* (2013.01); *H01R 12/52* (2013.01); *H01R 12/55* (2013.01); *H01R 12/7005* (2013.01); *H01R 13/42* (2013.01); *H01R 13/502* (2013.01); *H01R 13/514* (2013.01); *H01R 13/516* (2013.01); *H01R 2107/00* (2013.01)

(58) Field of Classification Search

CPC ..... H01R 13/11; H01R 13/113; H01R 12/52; H01R 12/55; H01R 13/114; H01R 13/115; H01R 13/193

See application file for complete search history.

(56) References Cited

U.S. PATENT DOCUMENTS 4,607,907 A 8/1986 Borgursky
4,687,278 A * 8/1987 Grabbe ..... H01R 13/114 439/842

(Continued)

FOREIGN PATENT DOCUMENTS

EP 0 700 122 B1 11/2001

OTHER PUBLICATIONS

European Search Report, dated Jun. 1, 2021, EP 21 15 3073, European Application No. 21153073.8-1201.

*Primary Examiner* — Renee S Luebke
*Assistant Examiner* — Paul D Baillargeon

(57) ABSTRACT

A socket contact includes a main body extending along a longitudinal axis between a mating end and a terminating end of the socket contact. The main body has a first side and a second side. The main body has a front and a rear extending between the first side and the second side. The socket contact includes a contact tail at the terminating end configured to be terminated to a circuit board. The socket contact includes a mating socket at the mating end. The mating socket includes a first beam and a second beam opposite the first beam. The mating socket includes a third beam longitudinally offset from the first beam and longitudinally offset from the second beam.

20 Claims, 6 Drawing Sheets

(51) Int. Cl.

| | |
|---|---|
| ***H01R 13/514*** | (2006.01) |
| ***H01R 13/516*** | (2006.01) |
| ***H01R 107/00*** | (2006.01) |

(56) References Cited

U.S. PATENT DOCUMENTS

| | | | | | |
|---|---|---|---|---|---|
| 4,795,379 | A * | 1/1989 | Sasaki | H01R 13/11 | 439/856 |
| 5,085,601 | A | 2/1992 | Buchter et al. | | |
| 5,681,190 | A * | 10/1997 | Childs | H01R 13/11 | 439/842 |
| 6,811,450 | B1 * | 11/2004 | Data | H01R 13/114 | 439/181 |
| 6,932,660 | B2 * | 8/2005 | Roepke | H01R 13/112 | 439/856 |
| 8,007,315 | B2 | 8/2011 | Whiteman, Jr. | | |
| 8,827,756 | B2 * | 9/2014 | Mueller | H01R 13/114 | 439/852 |
| 9,112,292 | B2 * | 8/2015 | Ogura | H01R 13/055 | |
| 2005/0014423 | A1 | 1/2005 | Roepke | | |
| 2011/0165784 | A1 | 7/2011 | Gulla | | |
| 2011/0294325 | A1 | 12/2011 | McAlonis et al. | | |
| 2013/0244504 | A1 | 9/2013 | Ogura | | |

* cited by examiner

SOCKET CONTACT FOR AN ELECTRICAL CONNECTOR

BACKGROUND OF THE INVENTION

The subject matter herein relates generally to socket contacts for electrical connectors.

Electrical connectors are used to electrically connect a circuit board or a cable assembly with another circuit board or cable assembly. The electrical connectors typically include electrical contacts that are mated to form electrical circuits between the circuit boards and/or the cable assemblies. For example, the electrical contacts may include socket contacts and pin contacts that are mated. Some known electrical contacts have deflectable mating beams having mating interfaces. However, the electrical contacts are subject to mechanical shock and vibration and may be subject to thermal expansion and contraction. Such shock, vibration and expansion/contraction may stress the mating beams and solder joints over time causing the mating beams to fail. Some known electrical contacts have multiple mating beams for redundant points of contact to mitigate discontinuity during vibration. However, increased mating beams leads to increased mating forces for mating the electrical contacts.

A need remains for an electrical connector having electrical contacts having reduced contact mating insertion forces.

BRIEF DESCRIPTION OF THE INVENTION

In one embodiment, a socket contact is provided including a main body extending along a longitudinal axis between a mating end and a terminating end of the socket contact. The main body has a first side and a second side. The main body has a front and a rear extending between the first side and the second side. The socket contact includes a contact tail at the terminating end configured to be terminated to a circuit board. The socket contact includes a mating socket at the mating end. The mating socket includes a first beam and a second beam opposite the first beam. The mating socket includes a third beam longitudinally offset from the first beam and longitudinally offset from the second beam.

In an embodiment, a socket contact is provided including a main body extending along a longitudinal axis between a mating end and a terminating end of the socket contact. The main body has a first side and a second side. The main body has a front and a rear extending between the first side and the second side. The socket contact includes a contact tail at the terminating end configured to be terminated to a circuit board. The socket contact includes a mating socket at the mating end. The mating socket includes a front wall, a rear wall, a first side wall between the front wall and the rear wall, and a second side wall between the front wall and the rear wall. The mating socket includes a receptacle surrounded by the front wall, the rear wall, the first side wall, and the second side wall configured to receive a pin of a pin contact. The mating socket includes a front beam extending from the front wall into the receptacle for mating with the pin, a rear beam extending from the rear wall into the receptacle for mating with the pin, a first side beam extending from the first side wall into the receptacle for mating with the pin, and a second side beam extending from the second side wall into the receptacle for mating with the pin. The first side beam is longitudinally offset from the front beam and the rear beam. The second side beam being and longitudinally offset from the front beam and the rear beam.

In an embodiment, an electrical connector is provided including a housing having contact channels between a mating end and mounting end mounted to a circuit board. The electrical connector includes socket contacts received in corresponding contact channels and coupled to the housing. Each socket contact includes a main body extending along a longitudinal axis between a mating end and a terminating end of the socket contact. The main body has a first side and a second side. The main body has a front and a rear extending between the first side and the second side. The socket contact includes a contact tail at the terminating end configured to be terminated to the circuit board. The socket contact includes a mating socket at the mating end. The mating socket includes a first beam and a second beam opposite the first beam. The mating socket includes a third beam longitudinally offset from the first beam and longitudinally offset from the second beam.

DETAILED DESCRIPTION OF THE INVENTION

Figure 1:
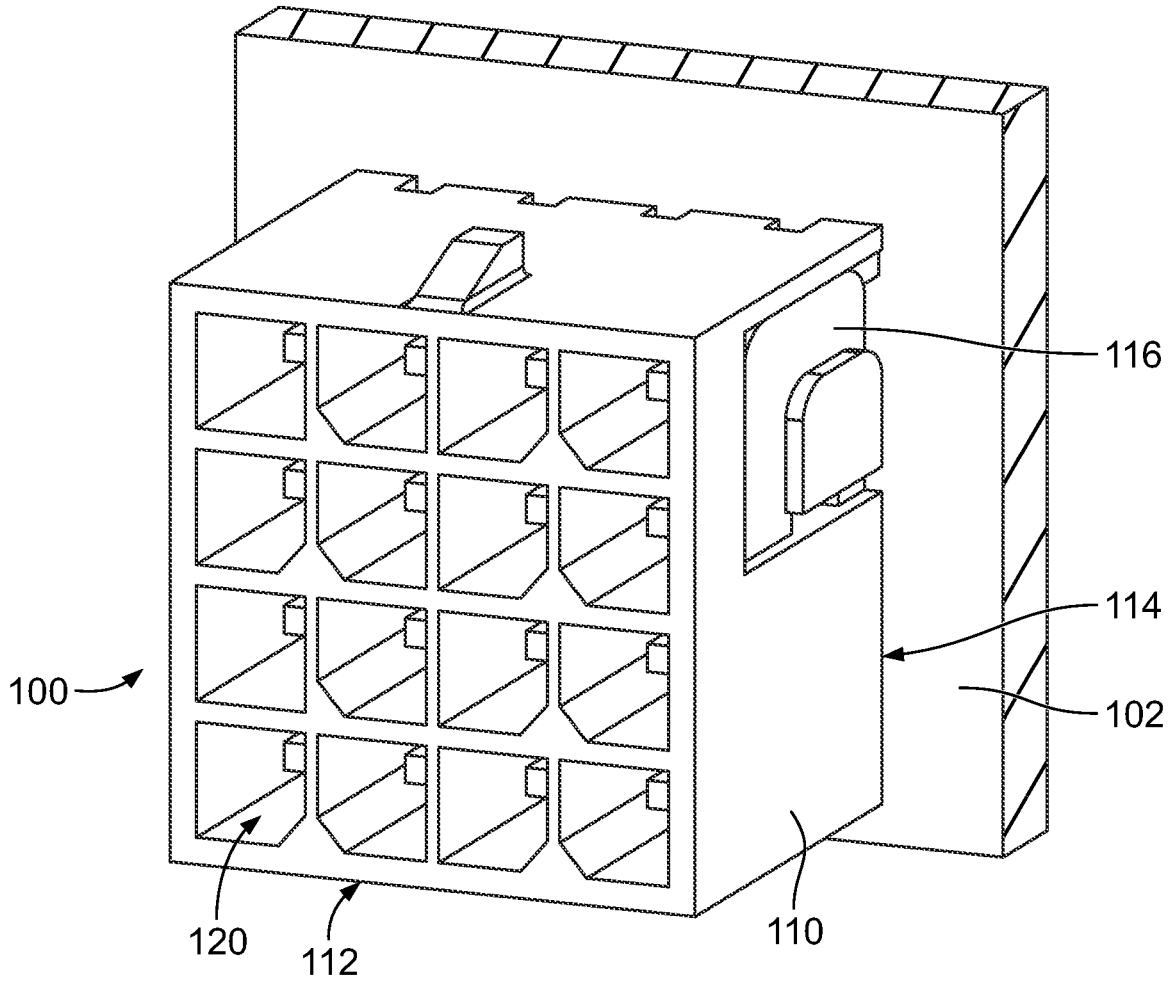
FIG. 1 is a perspective view of an electrical connector including socket contacts in accordance with an exemplary embodiment.

FIG. 1 is a perspective view of an electrical connector 100 in accordance with an exemplary embodiment. The electrical connector 100 is mounted to a circuit board 102. The electrical connector 100 is configured to be mated to a mating electrical connector (not shown). For example, the electrical connector 100 may be a socket connector and the mating electrical connector may be a plug connector. In various embodiments, the mating electrical connector is a cable mounted connector to form a wire-to-board electrical connection. In other various embodiments, the mating electrical connector is a board mounted connector to form a board-to-board electrical connection.

The electrical connector 100 includes a housing 110 having a mating end 112 and a mounting end 114. The mounting end 114 is configured to be mounted to the circuit board 102, such as using mounting hardware 116. The mating end 112 is configured to be mated with the mating electrical connector. The housing 110 includes a plurality of contact channels 120 extending between the mating end 112 and the mounting end 114. In an exemplary embodiment, socket contacts 200 (shown in FIG. 2) are received in corresponding contact channels 120. The socket contacts 200 configured to be mated with the mating electrical connector, such as to pin contacts of the mating electrical connector. The socket contacts 200 are configured to be terminated to the circuit board 102 at the mounting end 114. For example, the socket contacts 200 may be soldered to the circuit board 102. In other various embodiments, the socket contacts 200 may be press-fit into vias of the circuit board 102. In other various embodiments, the socket contacts 200 may be terminated to ends of wires, such as by a crimp connection.

Figure 2:
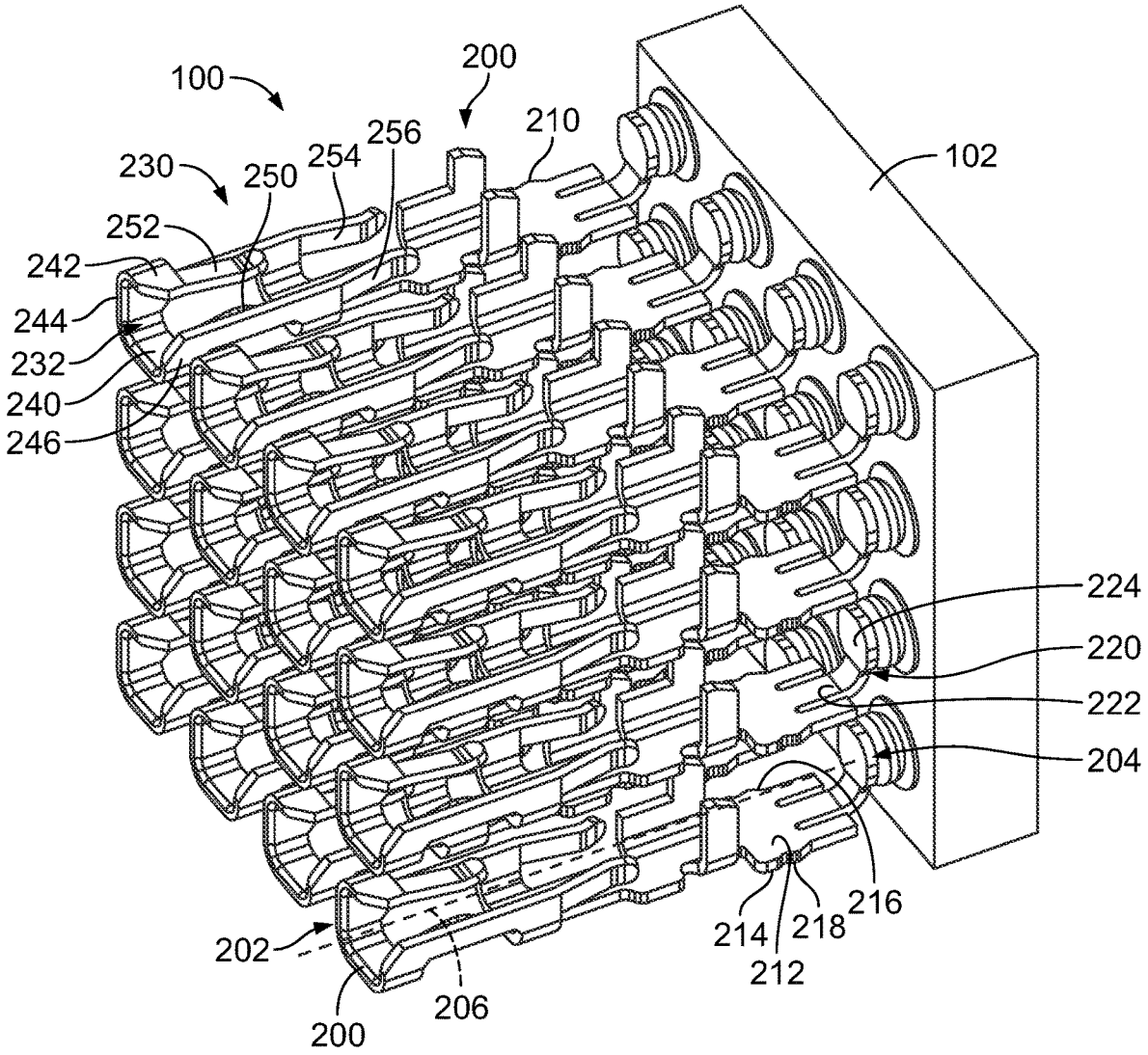
FIG. 2 is a perspective view of a portion of the electrical connector showing the socket contacts.

FIG. 2 is a perspective view of a portion of the electrical connector 100 showing the socket contacts 200 terminated to the circuit board 102 with the housing 110 (shown in FIG. 1) removed to illustrate the socket contacts 200. Each socket contact 200 extends between a mating end 202 and a terminating end 204. The socket contact 200 includes a main body 210 extending along a longitudinal axis 206 between the mating end 202 and the terminating end 204. In various embodiments, the socket contacts 200 may be oriented such that the mating end 202 is at a top of the socket contact 200 and the terminating end 204 is at a bottom of the socket contact 200. The socket contact 200 includes a contact tail 220 at the terminating end 204 and a mating socket 230 at the mating end 202. The contact tail 220 is configured to be terminated to the circuit board 102 (shown in FIG. 1). The mating socket 230 is configured to be mated to the mating electrical connector. For example, the mating socket 230 includes a receptacle 232 that receives a pin of a pin contact of the mating electrical connector.

The socket contact 200 is manufactured from a metal material. For example, the socket contact 200 may be a stamped and formed contact. The main body 210 includes a front 212 and a rear 214. The main body 210 includes a first side 216 and a second side 218. The front 212 and the rear 214 extend between the first and second sides 216, 218. The first and second sides 216, 218 may be defined by edges of the main body 210, such as cut edges formed during a stamping process. The main body 210 may be generally planar, for example, the front 212 and the rear 214 be generally planar. However, the main body 210 may have other shapes in alternative embodiments. For example, the main body 210 may include tabs or other features that are stamped and bent out of plane along the first and second sides 216, 218.

The contact tail 220 includes a neck 222 extending from the main body 210, such as a bottom of the main body 210. The contact tail 220 includes a foot 224 extending from the neck 222. The foot 224 is configured to be mounted to the circuit board 102. For example, the foot 224 may form a solder pad configured to be soldered to a circuit pad of the circuit board 102 using a solder ball. In an exemplary embodiment, foot 224 is bent out of plane relative to the main body 210 and the neck 222, such as being oriented perpendicular to the neck 222. The foot 224 may have other forms in alternative embodiments, such as being a compliant pin configured to be press-fit into the circuit board 102. The neck 222 is flexible between the foot 224 and the main body 210. For example, the neck 222 allows flexibility during mechanical shock and vibration. The neck 222 is flexible to allow thermal expansion of the socket contact 200. Optionally, the neck 222 may be narrower than the foot 224 and/or the main body 210.

The mating socket 230 is stamped and formed to form the receptacle 232. In an exemplary embodiment, the mating socket 230 extends along multiple sides of the receptacle 232. For example, the mating socket 230 may extend along three sides or four sides of the receptacle 232, to interface with multiple side of the pin of the pin contact. In the illustrated embodiment, the mating socket 230 extends along all four sides of the receptacle 232 to enclose the receptacle 232. The mating socket 230 includes a plurality of mating beams 234 extending into the receptacle 232 for mating with the pin of the pin contact. Each mating beam 234 has a corresponding mating interface for mating with the pin. As such, the mating socket 230 has a plurality of points of contact with the pin. In an exemplary embodiment, the mating beams 234 are longitudinally offset in the mating direction of the pin. As such, the mating forces are staggered (in time) during insertion of the pin into the receptacle 232. The mating beams 234 may be longitudinally offset to reduce capacitive coupling. The mating beams 234 may be longitudinally offset to increase differential impedance within the connector. In various embodiments, the mating beams 234 may be deflectable mating beams. For example, the mating beams 234 may be deflectable cantilevered beams in various embodiments. The mating beams 234 may be fixed beams that are fixed at both ends and flexible between the fixed ends, in various embodiments. The mating beams 234 may have different lengths and/or different fixed points to stagger the locations of the mating interfaces. The mating beams 234 may extend in different directions (for example, downward versus upward) to stagger the locations of the mating interfaces. In alternative embodiments, the mating beams 234 may be embossments, such as fixed protrusions that define mating interfaces. The embossments may be elongated in various embodiments. The embossments may be circular points in other various embodiments.

The mating socket 230 includes a front wall 240, rear wall 242 opposite the front wall 240, a first side wall 244, and a second side wall 246 opposite the first side wall 244. The first and second side walls 244, 246 extend between the top of the front wall 240 and the rear wall 242. In an alternative embodiment, the mating socket 230 may be provided at the rear wall 242 leaving the receptacle 232 open at the rear of the mating socket 230. In an exemplary embodiment, the front wall 240 is generally coplanar the main body 210. The front wall 240 extends from the top of the main body 210. The first side wall 244 extends from a first side of the front wall 240 and the second side wall 246 extends from a second side of the front wall 240. The rear wall 242 extends from the first side wall 244. Other configurations are possible in alternative embodiments, such as having the second side wall 246 extend from the rear wall 242 rather than the front wall 244.

In an exemplary embodiment, the mating beams 234 of the mating socket 230 include a front beam 250, a rear beam 252, a first side beam 254, and a second side beam 256. The mating beams 234 may include greater or fewer mating beams in alternative embodiments. The front beam 250 extends from the front wall 240 into the receptacle 232 for mating with the pin. The rear beam 252 extends from the rear wall 242 into the receptacle 232 for mating with the pin. The first side beam 254 extends from the first side wall 244 into the receptacle 232 for mating with the pin. The second side beam 256 extends from the second side wall 246 into the receptacle 232 for mating with the pin. In an exemplary embodiment, the first and second side beams 254, 256 are longitudinally offset respect to the front and rear beams 250, 252. For example, the first and second side beams 254, 256 are located closer to the main body 210, such as below the front and rear beams 250, 252. As such, the front and rear beams 250, 252 are mated to the pin prior to the first and second side beams 254, 256 during insertion of the pin into the receptacle 232. The mating forces associated with mating the front and rear beams 250, 252 peak and trail off prior to experiencing the mating forces associated with mating the first and second side beams 254, 256. As such, overall mating forces of mating the electrical connector 100 with the mating electrical connector are reduced. In various alternative embodiments, the front beam 250 may be longitudinally offset with respect to the rear beam 252 to stagger the mating forces associated with mating the front beam 250 and the rear beam 252. In various alternative embodiments, the first side beam 254 may be longitudinally offset with respect to the second side beam 256 to stagger the mating forces associated with mating the first side beam 254 and a second side beam 256. The mating beams 250, 252 and/or 254, 256 may be longitudinally offset to reduce capacitive coupling. The mating beams 250, 252 and/or 254, 256 may be longitudinally offset to increase differential impedance within the connector.

Figure 3:
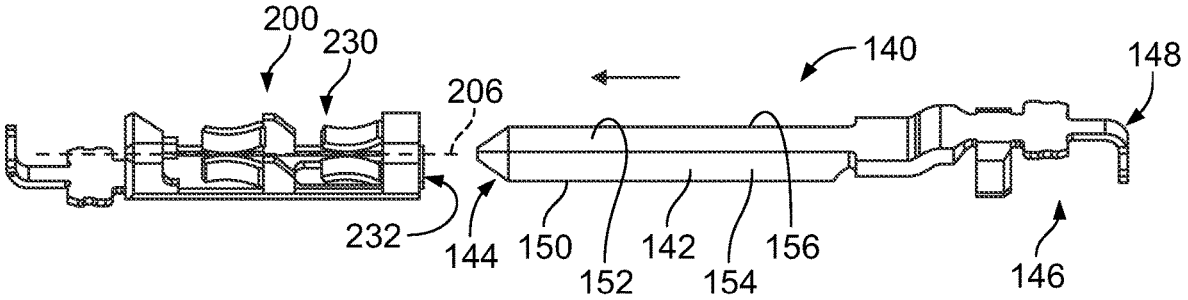
FIG. 3 is a perspective view of the socket contact poised for mating with a pin contact in accordance with an exemplary embodiment.

FIG. 3 is a perspective view of a portion of the electrical connector 100 showing one of the socket contacts 200 during mating with a pin contact 140 in accordance with an exemplary embodiment. FIG. 3 shows the pin contact 140 prior to insertion into the receptacle 232 of the socket contact 200. The pin contact 140 includes a pin 142 at a mating end 144 of pin contact 140. In the illustrated embodiment, a terminating end 146 of the pin contact 140 includes a contact tail 148 configured to be mounted to a circuit board (not shown). Other types of pin contacts may be used in alternative embodiments, such as a pin contact having a crimp barrel at the terminating end 146 configured to be crimped to a wire.

The pin contact 140 is configured to be loaded into the receptacle 232 in a mating direction parallel to the longitudinal axis 206 of the second contact 200. The pin contact 140 includes a plurality of sides, such as four sides (for example, a front side 150, a rear side 152, a first side 154, and a second side 156). In an exemplary embodiment, the mating socket 230 is configured to be mated to all four sides of the pin contact 140.

Figure 4:
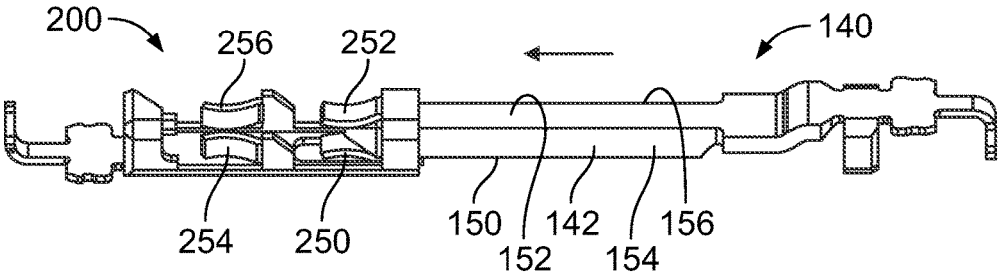
FIG. 4 is a perspective view of the socket contact showing the pin contact partially mated with the socket contact in accordance with an exemplary embodiment.
Figure 5:
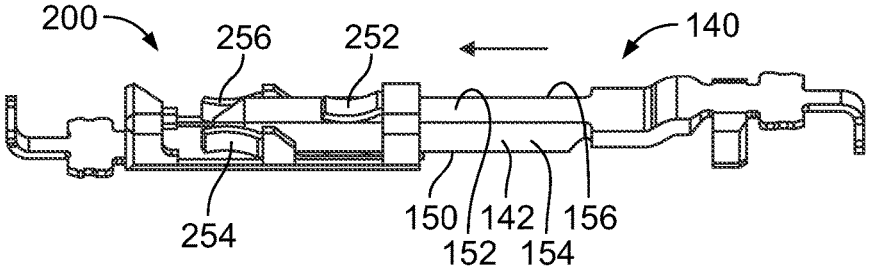
FIG. 5 is a perspective view of the socket contact showing the pin contact fully mated with the socket contact in accordance with an exemplary embodiment.

FIG. 4 is a perspective view of a portion of the electrical connector 100 showing the pin contact 140 partially mated with the socket contact 200 in accordance with an exemplary embodiment. FIG. 5 is a perspective view of a portion of the electrical connector 100 showing the pin contact 140 fully mated with the socket contact 200 in accordance with an exemplary embodiment. When partially mated (FIG. 4), the front beam 250 is mated with the front side 150 of the pin 142 and the rear beam 252 is mated with the rear side 152 of the pin 142. However, the first side beam 254 and the second side beam 256 are not mated with the first side 154 and the second side 156, respectively. The only mating forces experienced in the partially mated state are the mating forces associated with the front beam 250 and the rear beam 252. When fully mated (FIG. 5), the front beam 250 is mated with the front side 150 of the pin 142, the rear beam 252 is mated with the rear side 152 of the pin 142, the first side beam 254 is mated with the first side 154 of the pin 142, and the second side beam 256 is mated with the second side 156 of the pin 142.

In an exemplary embodiment, the socket contact 200 is electrically connected to the pin contact 140 through the mating interfaces. In the fully mated state (FIG. 5), the electrical paths are created through the front beam 250 with the front side 150, through the rear beam 252 with the rear side 152, through the first side beam 254 with the first side 154, and through the second side beam 256 with the second side 156. In the partially mated state (FIG. 4), the electrical paths are created through the front beam 250 with the front side 150 and the rear beam 252 with the rear side 152. In an exemplary embodiment, the partially mated state may define a testing position for testing electrical connections, such as electrical connections between the electrical connector 100 and the circuit board 102 (shown in FIG. 1) or between the mating electrical connector and the mating circuit board (or the wires). Test signals may be transmitted through the system and transmitted/received by each of the socket contacts 200 and/or transmitted/received by each of the pin contacts 140. Circuits that fail to receive the transmitted signals indicate a defective electrical connection through such circuit (for example, through the interface with the circuit board or wire. The electrical connector 100 may fail and/or be sent for service or repair. Because testing can be accomplished at the partially mated position, the mating forces for testing are reduced. Fatigue or damage of the contacts 200, 140 may be reduced by reducing the mating forces during testing.

Figure 6:
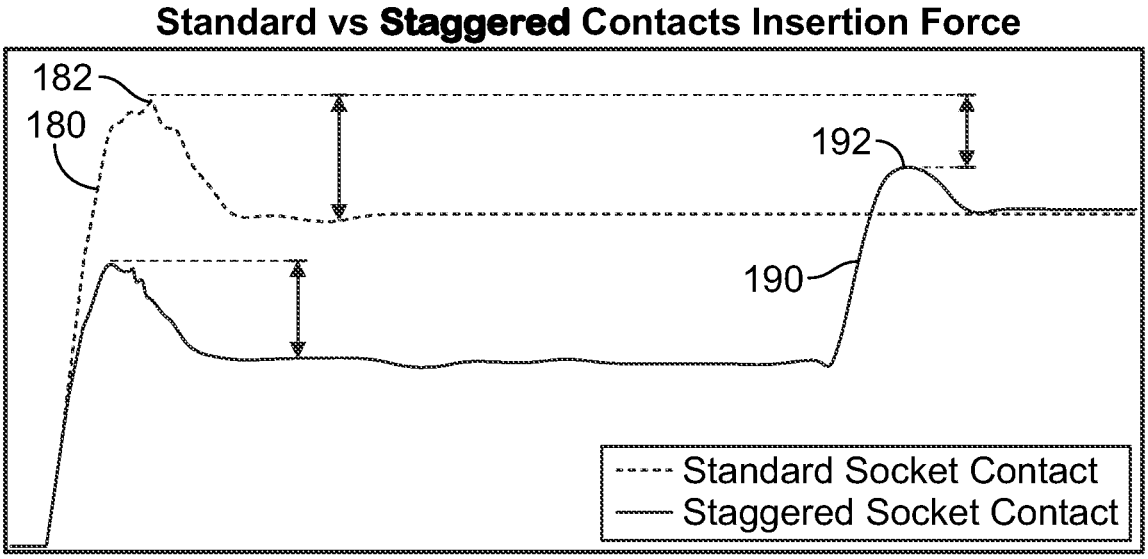
FIG. 6 is a plot showing mating forces using standard contacts versus mating forces using the socket contacts in accordance with an exemplary embodiment.

FIG. 6 is a plot showing mating forces 180 using standard contacts (for example, conventional socket contacts having four mating beams with mating interfaces that are aligned—not staggered) versus mating forces 190 using the socket contacts 200 having the staggered mating beams 234. Peak mating forces 192 of the socket contacts 200 are lower than peak mating forces 182 of the standard contacts. Wiping contact forces are lower than insertion forces. Thus, by staggering the timing of the insertion forces (for example, by staggering the mating beams 234, the socket contacts 200 have lower peak mating forces 192 than the conventional standard contacts.

Figure 7:
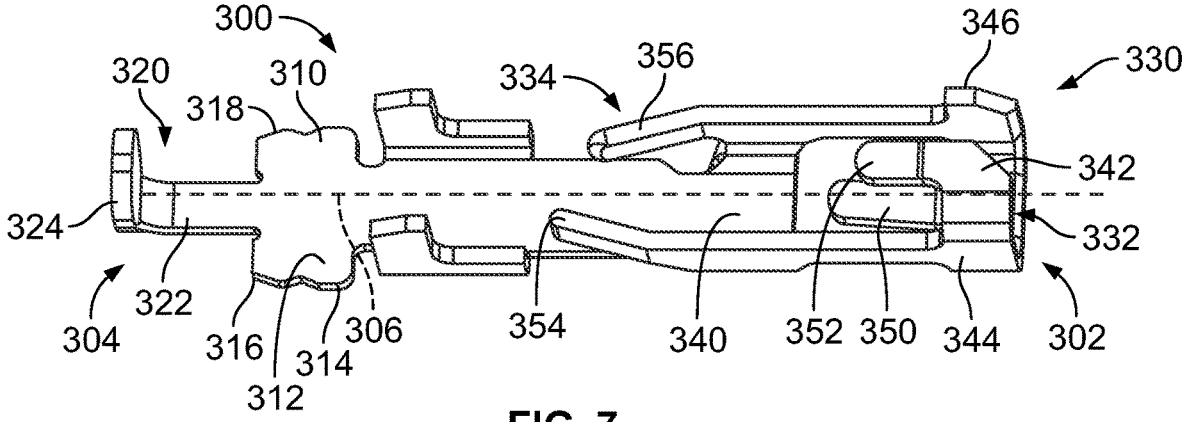
FIG. 7 is a perspective view of the socket contact in accordance with an exemplary embodiment.

FIG. 7 is a perspective view of a socket contact 300 in accordance with an exemplary embodiment. The socket contact 300 extends between a mating end 302 and a terminating end 304. The socket contact 300 includes a main body 310 extending along a longitudinal axis 306 between the mating end 302 and the terminating end 304. The socket contact 300 includes a contact tail 320 at the terminating end 304 and a mating socket 330 at the mating end 302. The mating socket 330 includes a receptacle 332 that receives the pin 142 of the pin contact 140 (shown in FIG. 3).

The main body 310 includes a front 312 and a rear 314. The main body 310 includes a first side 316 and a second side 318. The contact tail 320 includes a neck 322 extending from the main body 310 and a foot 324 extending from the neck 322 configured to be mounted to the circuit board 102.

The mating socket 330 is stamped and formed to form the receptacle 332. In the illustrated embodiment, the mating socket 330 extends along all four sides of the receptacle 332 to enclose the receptacle 332. The mating socket 330 includes a plurality of mating beams 334 extending into the receptacle 332 for mating with the pin 142 of the pin contact 140. The mating beams 334 are longitudinally offset in the mating direction. As such, the mating forces are staggered (in time) during insertion of the pin 142 into the receptacle 332. The mating socket 330 includes a front wall 340, rear wall 342 opposite the front wall 340, a first side wall 344, and a second side wall 346 opposite the first side wall 344. In an exemplary embodiment, the mating socket 330 includes a front beam 350, a rear beam 352, a first side beam 354, and a second side beam 356. The mating beams 334 may include greater or fewer mating beams in alternative embodiments. In an exemplary embodiment, the front beam 350 and the rear beam 352 are asymmetric. For example, the front beam 350 is longer than the rear beam 352 such that the mating interfaces are offset and staggered. As such, the mating forces of the front beam 350 and the rear beam 352 are staggered, which lowers the overall mating forces. In an exemplary embodiment, the first side beam 354 and the second side beam 356 are asymmetric. For example, the first side beam 354 is longer than the second side beam 356 such that the mating interfaces are offset and staggered. As such, the mating forces of the first side beam 354 and the second side beam 356 are staggered, which lowers the overall mating forces.

Figure 8:
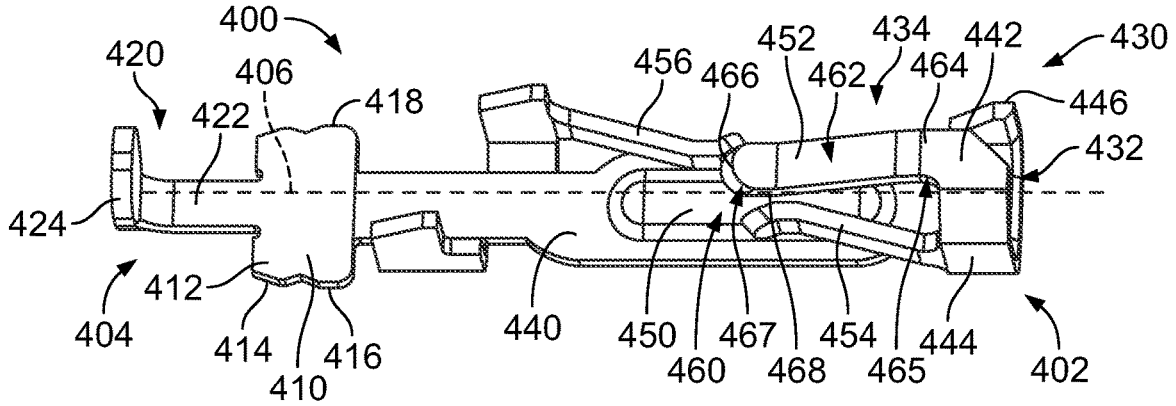
FIG. 8 is a perspective view of the socket contact in accordance with an exemplary embodiment.

FIG. 8 is a perspective view of a socket contact 400 in accordance with an exemplary embodiment. The socket contact 400 extends between a mating end 402 and a terminating end 404. The socket contact 400 includes a main body 410 extending along a longitudinal axis 406 between the mating end 402 and the terminating end 404. The socket contact 400 includes a contact tail 420 at the terminating end 404 and a mating socket 430 at the mating end 402. The mating socket 430 includes a receptacle 432 that receives the pin 142 of the pin contact 140 (shown in FIG. 4).

The main body 410 includes a front 412 and a rear 414. The main body 410 includes a first side 416 and a second side 418. The contact tail 420 includes a neck 422 extending from the main body 410 and a foot 424 extending from the neck 422 configured to be mounted to the circuit board 102.

The mating socket 430 is stamped and formed to form the receptacle 432. In the illustrated embodiment, the mating socket 430 extends along all four sides of the receptacle 432 to enclose the receptacle 432. The mating socket 430 includes a plurality of mating beams 434 extending into the receptacle 432 for mating with the pin 142 of the pin contact 140. The mating beams 434 are longitudinally offset in the mating direction. As such, the mating forces are staggered (in time) during insertion of the pin 142 into the receptacle 432. The mating socket 430 includes a front wall 440, rear wall 442 opposite the front wall 440, a first side wall 444, and a second side wall 446 opposite the first side wall 444.

In an exemplary embodiment, the mating socket 430 includes a front beam 450 extending from the front wall 440, a rear beam 452 extending from the rear wall 442, a first side beam 454 extending from the first side wall 444, and a second side beam 456 extending from the second side wall 446. The mating beams 434 may include greater or fewer mating beams in alternative embodiments. In the illustrated embodiment, the front beam 450 is an embossment 460 extending into the receptacle 432 and the rear beam 452 is a cantilevered beam 462 having a proximal end 464 and a distal end 466 opposite the proximal end 464. The proximal end 464 is a fixed end 465 fixed to the wall 442. The distal end 466 is a free end 467 movable relative to the wall 442. The distal end 466 has a mating interface 468. The mating interface 468 is offset from the mating interface of the embossment 460 to stagger the mating forces and lowers the overall mating forces. In an exemplary embodiment, the first side beam 454 and the second side beam 456 are both cantilevered beams. However, the first side beam 454 and the second side beam 456 extend in different directions. For example, the first side beam 454 extends in a downward direction and the second side beam 456 extends in an upward direction. The mating interfaces of the first and second side beams 454, 456 are staggered and may be staggered relative to the mating interfaces of the front beam 450 and/or the rear beam 452, which lowers the overall mating forces.

Figure 9:
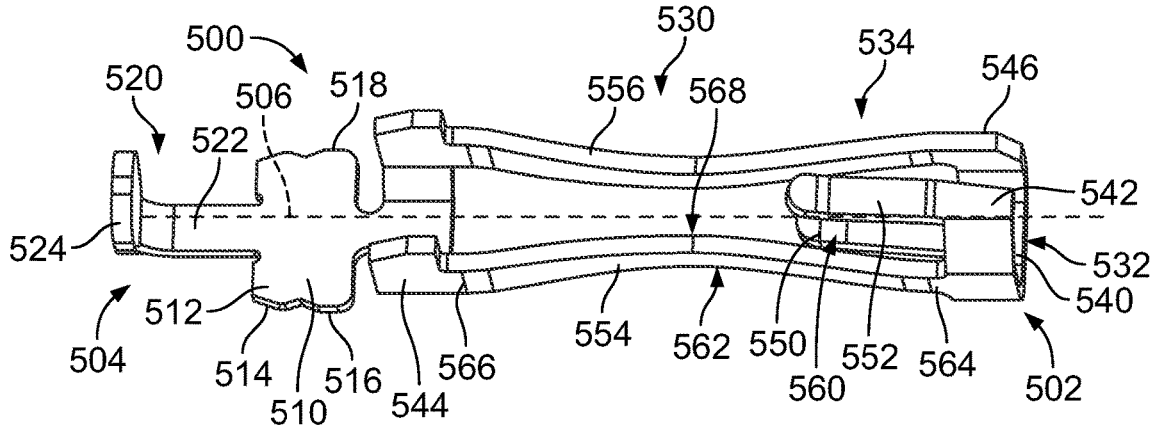
FIG. 9 is a perspective view of the socket contact in accordance with an exemplary embodiment.

FIG. 9 is a perspective view of a socket contact 500 in accordance with an exemplary embodiment. The socket contact 500 extends between a mating end 502 and a terminating end 504. The socket contact 500 includes a main body 510 extending along a longitudinal axis 506 between the mating end 502 and the terminating end 504. The socket contact 500 includes a contact tail 520 at the terminating end 504 and a mating socket 530 at the mating end 502. The mating socket 530 includes a receptacle 532 that receives the pin 142 of the pin contact 140 (shown in FIG. 5).

The main body 510 includes a front 512 and a rear 514. The main body 510 includes a first side 516 and a second side 518. The contact tail 520 includes a neck 522 extending from the main body 510 and a foot 524 extending from the neck 522 configured to be mounted to the circuit board 102.

The mating socket 530 is stamped and formed to form the receptacle 532. In the illustrated embodiment, the mating socket 530 extends along all four sides of the receptacle 532 to enclose the receptacle 532. The mating socket 530 includes a plurality of mating beams 534 extending into the receptacle 532 for mating with the pin 142 of the pin contact 140. The mating beams 534 are longitudinally offset in the mating direction. As such, the mating forces are staggered (in time) during insertion of the pin 142 into the receptacle 532. The mating socket 530 includes a front wall 540, rear wall 542 opposite the front wall 540, a first side wall 544, and a second side wall 546 opposite the first side wall 544.

In an exemplary embodiment, the mating socket 530 includes a front beam 550 extending from the front wall 540, a rear beam 552 extending from the rear wall 542, a first side beam 554 extending from the first side wall 544, and a second side beam 556 extending from the second side wall 546. The mating beams 534 may include greater or fewer mating beams in alternative embodiments. In the illustrated embodiment, the front beam 550 is a cantilevered beam and the rear beam 552 is a cantilevered beam. The cantilevered beams have fixed proximal ends and free distal ends including mating interfaces 560. In an exemplary embodiment, the first side beam 554 and the second side beam 556 are both fixed beams 562. Each fixed beam 562 has a proximal end 564 and a distal end 566. The proximal end 564 is a fixed end fixed to the wall 544 and the distal end 566 is a fixed end fixed to the wall 546. The fixed beam 562 is movable or deflectable between the fixed proximal and distal ends 564, 566 movable relative to the walls 544, 546. The fixed beam 562 has a mating interface 568, such as approximately centered between the fixed proximal and distal ends 564, 566. The mating interfaces 568 may be longitudinally offset from each other and/or may be longitudinally offset from the mating interfaces 560 of the front and rear beams 550, 552 to stagger the mating forces and lowers the overall mating forces.

Figure 10:
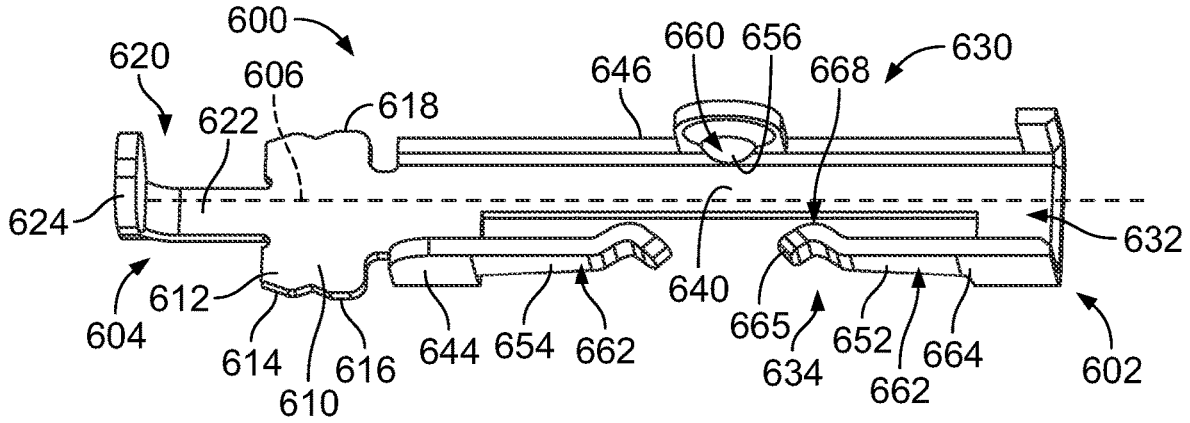
FIG. 10 is a perspective view of the socket contact in accordance with an exemplary embodiment.

FIG. 10 is a perspective view of a socket contact 600 in accordance with an exemplary embodiment. The socket contact 600 extends between a mating end 602 and a terminating end 604. The socket contact 600 includes a main body 610 extending along a longitudinal axis 606 between the mating end 602 and the terminating end 604. The socket contact 600 includes a contact tail 620 at the terminating end 604 and a mating socket 630 at the mating end 602. The mating socket 630 includes a receptacle 632 that receives the pin 142 of the pin contact 140 (shown in FIG. 6).

The main body 610 includes a front 612 and a rear 614. The main body 610 includes a first side 616 and a second side 618. The contact tail 620 includes a neck 622 extending from the main body 610 and a foot 624 extending from the neck 622 configured to be mounted to the circuit board 102.

The mating socket 630 is stamped and formed to form the receptacle 632. In the illustrated embodiment, the mating socket 630 extends along three sides of the receptacle 632 leaving the rear side open. The mating socket 630 includes a plurality of mating beams 634 extending into the receptacle 632 for mating with the pin 142 of the pin contact 140. The mating beams 634 are longitudinally offset in the mating direction. As such, the mating forces are staggered (in time) during insertion of the pin 142 into the receptacle 632. The mating socket 630 includes a front wall 640, rear wall 642 opposite the front wall 640, a first side wall 644, and a second side wall 646 opposite the first side wall 644.

In an exemplary embodiment, the mating socket 630 includes first and second side beams 652, 654 extending from the first side wall 644 and a third side beam 656 extending from the second side wall 646. The mating beams 634 may include greater or fewer mating beams in alternative embodiments. In the illustrated embodiment, the third side beam 656 is an embossment 660 extending into the receptacle 632. The first and second side beams 652, 654 are cantilevered beams 662 each having a fixed proximal end 664 and a free distal end 666. Mating interfaces 668 of the cantilevered beams 662 are offset from each other and offset from the embossment 660 to stagger the mating forces and lowers the overall mating forces.

Figure 11:
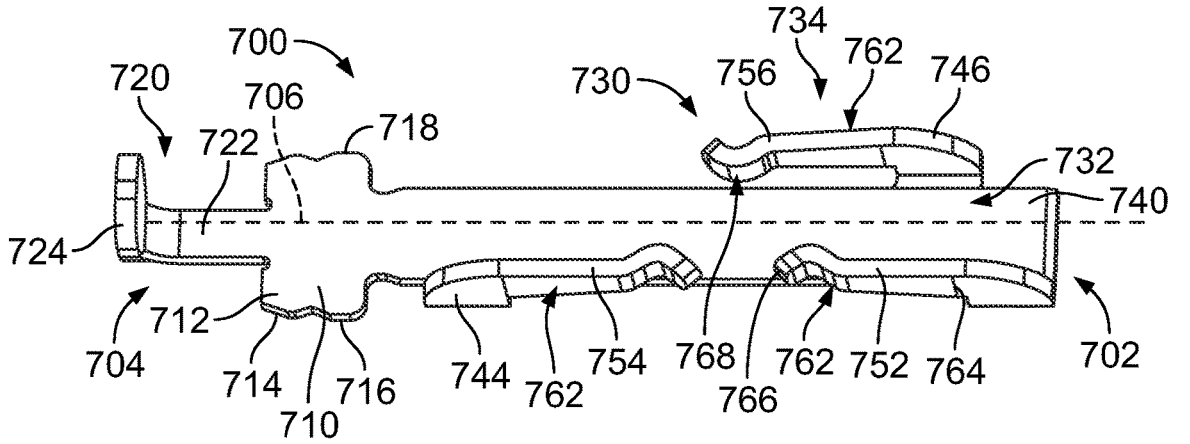
FIG. 11 is a perspective view of the socket contact in accordance with an exemplary embodiment.

FIG. 11 is a perspective view of a socket contact 700 in accordance with an exemplary embodiment. The socket contact 700 extends between a mating end 702 and a terminating end 704. The socket contact 700 includes a main body 710 extending along a longitudinal axis 706 between the mating end 702 and the terminating end 704. The socket contact 700 includes a contact tail 720 at the terminating end 704 and a mating socket 730 at the mating end 702. The mating socket 730 includes a receptacle 732 that receives the pin 142 of the pin contact 140 (shown in FIG. 7).

The main body 710 includes a front 712 and a rear 714. The main body 710 includes a first side 716 and a second side 718. The contact tail 720 includes a neck 722 extending from the main body 710 and a foot 724 extending from the neck 722 configured to be mounted to the circuit board 102.

The mating socket 730 is stamped and formed to form the receptacle 732. In the illustrated embodiment, the mating socket 730 extends along three sides of the receptacle 732 leaving the rear side open. The mating socket 730 includes a plurality of mating beams 734 extending into the receptacle 732 for mating with the pin 142 of the pin contact 140. The mating beams 734 are longitudinally offset in the mating direction. As such, the mating forces are staggered (in time) during insertion of the pin 142 into the receptacle 732. The mating socket 730 includes a front wall 740, rear wall 742 opposite the front wall 740, a first side wall 744, and a second side wall 746 opposite the first side wall 744.

In an exemplary embodiment, the mating socket 730 includes first and second side beams 752, 754 extending from the first side wall 744 and a third side beam 756 extending from the second side wall 746. The mating beams 734 may include greater or fewer mating beams in alternative embodiments. In the illustrated embodiment, the side beams 742, 754, 756 are cantilevered beams 762 each having a fixed proximal end 764 and a free distal end 766. Mating interfaces 768 of the cantilevered beams 762 are offset from each other to stagger the mating forces and lowers the overall mating forces.

Figure 12:
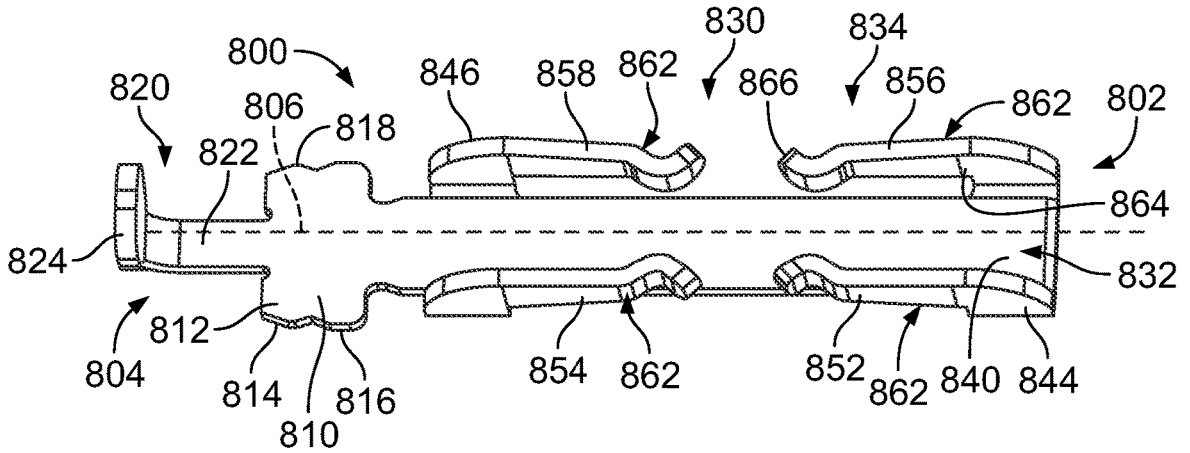
FIG. 12 is a perspective view of the socket contact in accordance with an exemplary embodiment.

FIG. 12 is a perspective view of a socket contact 800 in accordance with an exemplary embodiment. The socket contact 800 extends between a mating end 802 and a terminating end 804. The socket contact 800 includes a main body 810 extending along a longitudinal axis 806 between the mating end 802 and the terminating end 804. The socket contact 800 includes a contact tail 820 at the terminating end 804 and a mating socket 830 at the mating end 802. The mating socket 830 includes a receptacle 832 that receives the pin 142 of the pin contact 140 (shown in FIG. 8).

The main body 810 includes a front 812 and a rear 814. The main body 810 includes a first side 816 and a second side 818. The contact tail 820 includes a neck 822 extending from the main body 810 and a foot 824 extending from the neck 822 configured to be mounted to the circuit board 102.

The mating socket 830 is stamped and formed to form the receptacle 832. In the illustrated embodiment, the mating socket 830 extends along three sides of the receptacle 832 leaving the rear side open. The mating socket 830 includes a plurality of mating beams 834 extending into the receptacle 832 for mating with the pin 142 of the pin contact 140. The mating beams 834 are longitudinally offset in the mating direction. As such, the mating forces are staggered (in time) during insertion of the pin 142 into the receptacle 832. The mating socket 830 includes a front wall 840, rear wall 842 opposite the front wall 840, a first side wall 844, and a second side wall 846 opposite the first side wall 844.

In an exemplary embodiment, the mating socket 830 includes first and second side beams 852, 854 extending from the first side wall 844 and third and fourth side beams 856, 858 extending from the second side wall 846. The mating beams 834 may include greater or fewer mating beams in alternative embodiments. In the illustrated embodiment, the side beams 842, 854, 856, 858 are cantilevered beams 862 each having a fixed proximal end 864 and a free distal end 866. The mating interfaces of the first and third side beams 852, 856 are offset from the mating interfaces of the second and fourth side beams 854, 858 to stagger the mating forces and lowers the overall mating forces. The mating interfaces of the first and third side beams 852, 856 may be offset from each other. The mating interfaces of the second and fourth side beams 854, 858 may be offset from each other.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A socket contact comprising:

a main body extending along a longitudinal axis between a mating end and a terminating end of the socket contact, the main body having a first side and a second side, the main body having a front and a rear extending between the first side and the second side;

a contact tail at the terminating end, the contact tail configured to be terminated to a circuit board; and a mating socket at the mating end, the mating socket including a first beam and a second beam opposite the first beam, the mating socket including a third beam having a mating interface longitudinally offset from a mating interface of the first beam and longitudinally offset from a mating interface of the second beam, wherein the first beam is a cantilevered beam having a proximal end being a fixed end a distal end being a free end, the third beam being a fixed beam having a proximal end being a fixed end and a distal end being a fixed end.

2. The socket contact of claim 1, wherein the mating interface of the first beam is longitudinally offset from the mating interface of the second beam.

3. The socket contact of claim 1, further comprising a fourth beam opposite the third beam, the fourth beam having a mating interface being longitudinally offset from the mating interface of the first beam and being longitudinally offset from the mating interface of the second beam.

4. The socket contact of claim 1, wherein the mating socket includes a front wall, a rear wall, a first side wall between the front wall and the rear wall, and a second side wall between the front wall and the rear wall, the mating socket including a receptacle surrounded by the front wall, the rear wall, the first side wall, and the second side wall, the receptacle is configured to receive a pin of a pin contact, the first beam being a front beam extending from the front wall into the receptacle for mating with the pin, the second beam being a rear beam extending from the rear wall into the receptacle for mating with the pin, the third beam being a first side beam extending from the first side wall into the receptacle for mating with the pin, the mating socket including a fourth beam being a second side beam extending from the second side wall into the receptacle for mating with the pin, a mating interface of the second side beam being longitudinally offset from the mating interface of the front beam and the mating interface of the rear beam.

5. The socket contact of claim 4, wherein the front beam extends in a first direction, at least one of the rear beam, the first side beam, or the second side beam extending in a second direction opposite the first direction.

6. The socket contact of claim 1, wherein the first beam, the second beam, and the third beam are configured to engage different sides of a pin of a pin contact received in the mating socket.

7. The socket contact of claim 1, wherein the first beam extends in a first direction, the third beam extending in a second direction opposite the first direction.

8. The socket contact of claim 1, wherein the first beam has a first length and the third beam has a second length different from the first length.

9. The socket contact of claim 1, wherein the first beam is a cantilevered beam having a proximal end being a fixed end and a distal end being a free end, the third beam being an embossment.

10. The socket contact of claim 1, wherein the first beam and the second beam are asymmetric.

11. The socket contact of claim 1, wherein the mating socket is configured to receive a pin of a pin contact in a testing position and a mated position, each of the first beam, the second beam, and the third beam engaging the pin in the mated position, at least one of the first beam, the second beam, or the third beam being disengaged from the pin in the testing position.

12. A socket contact comprising:

a main body extending along a longitudinal axis between a mating end and a terminating end of the socket contact, the main body having a first side and a second side, the main body having a front and a rear extending between the first side and the second side;

a contact tail at the terminating end, the contact tail configured to be terminated to a circuit board; and a mating socket at the mating end, the mating socket including a front wall, a rear wall, a first side wall between the front wall and the rear wall, and a second side wall between the front wall and the rear wall, the mating socket including a receptacle surrounded by the front wall, the rear wall, the first side wall, and the second side wall, the receptacle is configured to receive a pin of a pin contact, the mating socket including a front beam extending from the front wall into the receptacle for mating with the pin, the mating socket including a rear beam extending from the rear wall into the receptacle for mating with the pin, the mating socket including a first side beam extending from the first side wall into the receptacle for mating with the pin, the mating socket including a second side beam extending from the second side wall into the receptacle for mating with the pin, the first side beam having a mating interface being longitudinally offset from a mating interface of the front beam and a mating interface of the rear beam, the second side beam having a mating interface being longitudinally offset from the mating interface of the front beam and the mating interface of the rear beam, wherein the front beam extends in a first direction, at least one of the rear beam, the first side beam, or the second side beam extending in a second direction opposite the first direction.

13. The socket contact of claim 12, wherein the front beam is longitudinally offset from the rear beam.

14. The socket contact of claim 12, wherein the first side beam is longitudinally offset from the second side beam.

15. The socket contact of claim 12, wherein the front beam has a first length, at least one of the rear beam, the first side beam, or the second side beam having a second length different from the first length.

16. The socket contact of claim 12, wherein at least one of the front beam, the rear beam, the first side beam, or the second side beam being a cantilevered beam having a proximal end being a fixed end a distal end being a free end, and wherein at least one of the front beam, the rear beam, the first side beam, or the second side beam being an embossment.

17. The socket contact of claim 12, wherein at least one of the front beam, the rear beam, the first side beam, or the second side beam being a cantilevered beam having a proximal end being a fixed end a distal end being a free end, and wherein at least one of the front beam, the rear beam, the first side beam, or the second side beam being a fixed beam having a proximal end being a fixed end and a distal end being a fixed end.

18. The socket contact of claim 12, wherein the front beam and the rear beam are asymmetric.

19. An electrical connector comprising:

a housing having a mating end and mounting end, the mounting end being mounted to a circuit board, the housing having contact channels between the mating end and the mounting end; and socket contacts coupled to the housing, the socket contacts received in corresponding contact channels, each socket contact comprising:

a main body extending along a longitudinal axis between a mating end and a terminating end of the socket contact, the main body having a first side and a second side, the main body having a front and a rear extending between the first side and the second side;

a contact tail at the terminating end, the contact tail configured to be terminated to the circuit board; and a mating socket at the mating end, the mating socket including a first beam and a second beam opposite the first beam, the mating socket including a third beam having a mating interface longitudinally offset from a mating interface of the first beam and longitudinally offset from a mating interface of the second beam, wherein the first beam is a cantilevered beam having a proximal end being a fixed end a distal end being a free end, the third beam being a fixed beam having a proximal end being a fixed end and a distal end being a fixed end.

20. The electrical connector of claim 19, wherein the mating socket includes a front wall, a rear wall, a first side wall between the front wall and the rear wall, and a second side wall between the front wall and the rear wall, the mating socket including a receptacle surrounded by the front wall, the rear wall, the first side wall, and the second side wall, the receptacle is configured to receive a pin of a pin contact, the first beam being a front beam extending from the front wall into the receptacle for mating with the pin, the second beam being a rear beam extending from the rear wall into the receptacle for mating with the pin, the third beam being a first side beam extending from the first side wall into the receptacle for mating with the pin, the mating socket including a fourth beam being a second side beam extending from the second side wall into the receptacle for mating with the pin, a mating interface of the second side beam being longitudinally offset from the mating interface of the front beam and the mating interface of the rear beam, wherein the front beam extends in a first direction, at least one of the rear beam, the first side beam, or the second side beam extending in a second direction opposite the first direction.

* * * * *